US005970532A

United States Patent [19]

Modica

[11] Patent Number: 5,970,532

[45] Date of Patent: Oct. 26, 1999

[54] RECLINING SHAMPOO SUPPORT FOR CHILDREN

[76] Inventor: Carolyn Modica, 6845 Tallow Dr., Beaumont, Tex. 77713

[21] Appl. No.: 09/026,423

[22] Filed: Feb. 19, 1998

[51] Int. Cl.[6] ..... A45D 44/10

[52] U.S. Cl. ..... 4/523; 4/575.1

[58] Field of Search ..... 4/516, 519, 523, 4/559, 575.1, 605, 611, 621

[56] References Cited

U.S. PATENT DOCUMENTS

| | | | |
|---|---|---|---|
| 2,592,160 | 4/1952 | Kunes | 4/575.1 |
| 2,818,585 | 1/1958 | Campbell | 4/523 X |
| 5,014,371 | 5/1991 | Heel | 4/519 X |

*Primary Examiner*—Robert M. Fetsuga

[57] ABSTRACT

A child support for supporting the head of a child for bathing purposes comprises a base having a top face, a bottom face, a pair of elongated side faces and a pair of short end faces. One of the end faces has a first gear fixedly coupled thereto in coplanar relationship with one of the side faces. The bottom face of the base has a plurality of suction cups mounted thereon. A reclining head rest has a top face, a bottom face, a pair of side faces and a pair of end faces. A bottom one of the end faces has a pair of tabs integrally coupled thereto and extending therefrom in coplanar relationship with the side faces of the reclining head rest for pivotally coupling with the side faces of the base adjacent to the end face to which the first gear is coupled. The reclining head rest has a dial rotatably coupled to one of the side faces thereof with a second gear coupled thereto and residing within an interior space of the reclining head rest and in engagement with the first gear of the base for allowing the selective pivoting of the reclining head rest by way of the rotation of the dial. A top end face of the of the reclining head rest has a cutout formed therein for receiving a neck of a child. The reclining head rest also has a support plate pivotally coupled along the top end face thereof.

3 Claims, 3 Drawing Sheets

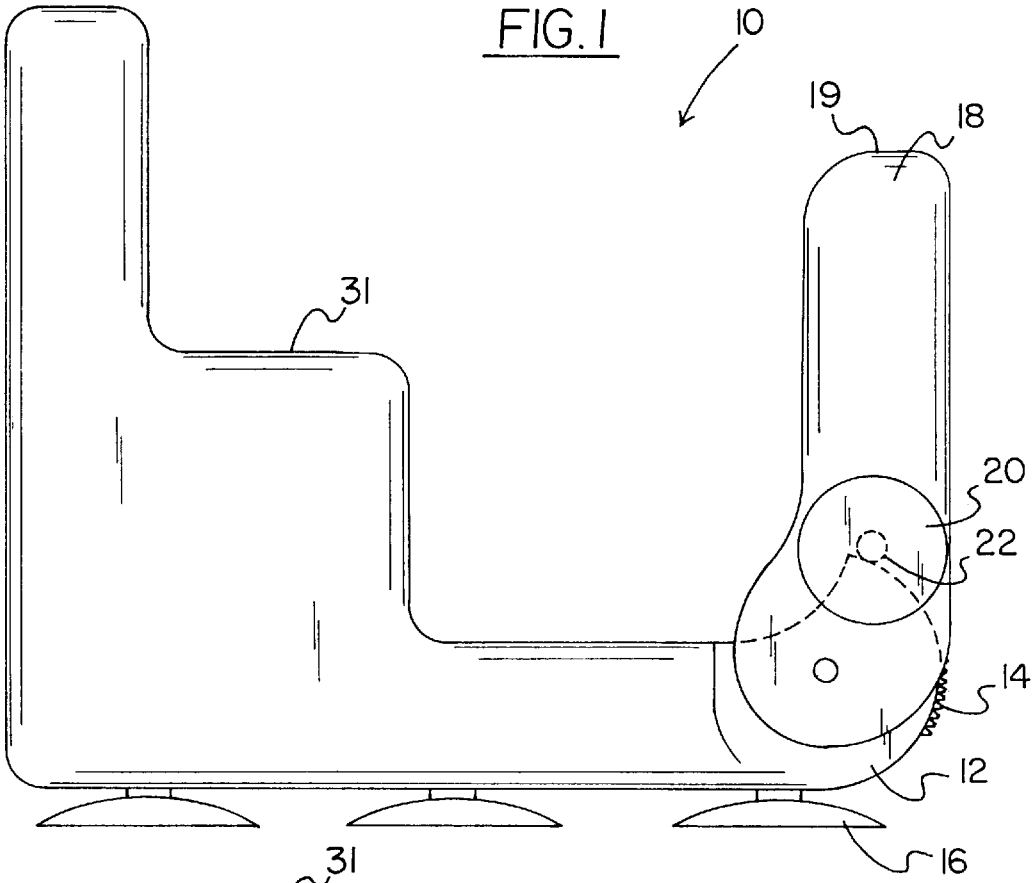
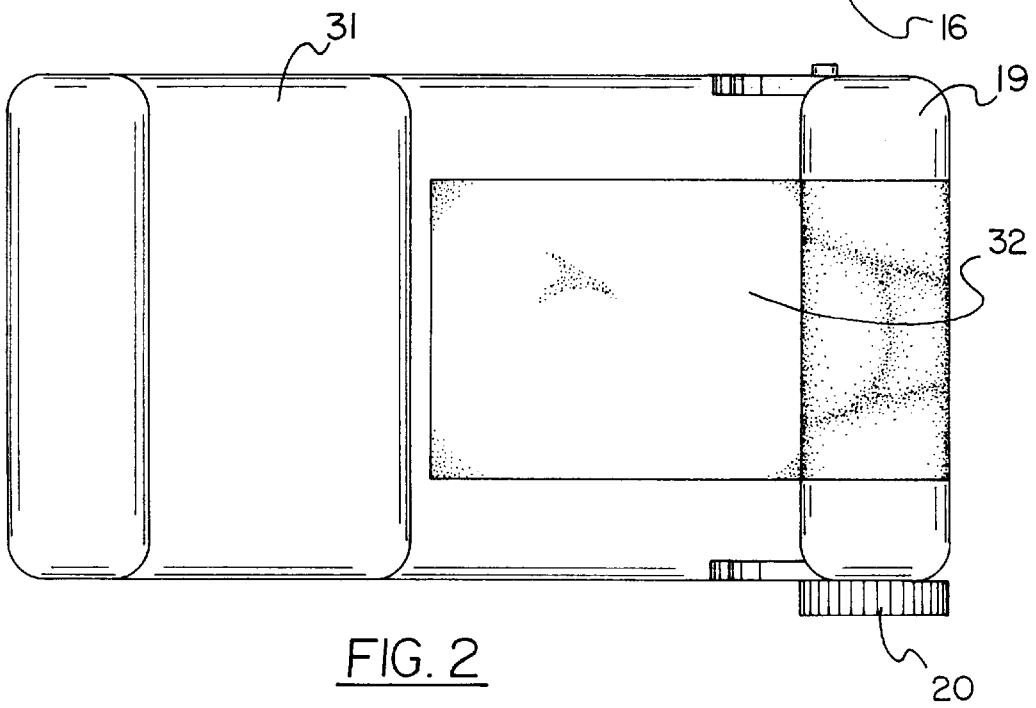
FIG. 2

RECLINING SHAMPOO SUPPORT FOR CHILDREN

BACKGROUND OF THE INVENTION

1. Field of the Invention

The present invention relates to child shampoo supports and more particularly pertains to a new reclining shampoo support for children for supporting a head of a child at various angles for shampooing purposes.

2. Description of the Prior Art

The use of child shampoo supports is known in the prior art. More specifically, child shampoo supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art child shampoo supports include U.S. Pat. No. 4,754,503; U.S. Pat. No. 3,965,496; U.S. Pat. No. 5,022,102; U.S. Pat. No. 4,765,003; U.S. Pat. No. 4,167,048; and U.S. Patent Des. 267,599.

In these respects, the reclining shampoo support for children according to the present invention substantially departs from the conventional concepts and designs of the prior art, and in so doing provides an apparatus primarily developed for the purpose of supporting a head of a child at various angles for shampooing purposes.

SUMMARY OF THE INVENTION

In view of the foregoing disadvantages inherent in the known types of child shampoo supports now present in the prior art, the present invention provides a new reclining shampoo support for children construction wherein the same can be utilized for supporting a head of a child at various angles for shampooing purposes.

The general purpose of the present invention, which will be described subsequently in greater detail, is to provide a new reclining shampoo support for children apparatus and method which has many of the advantages of the child shampoo supports mentioned heretofore and many novel features that result in a new reclining shampoo support for children which is not anticipated, rendered obvious, suggested, or even implied by any of the prior art child shampoo supports, either alone or in any combination thereof.

To attain this, the present invention generally comprises a base having a rectangular configuration with a top face, a bottom face, and a periphery formed therebetween. Such periphery is defined by a pair of elongated side faces and a pair of short end faces. One of the end faces has a first gear fixedly coupled thereto in coplanar relationship with one of the side faces for reasons that will become apparent hereinafter. The bottom face of the base has a plurality of suction cups mounted thereon and depending therefrom for coupling with a tub, as shown in FIG. 1. Next provided is a reclining head rest having a square configuration with a top face, a bottom face, and a periphery formed therebetween. Such periphery is defined by a pair of side faces and a pair of end faces. A bottom one of the end faces has a pair of tabs integrally coupled thereto and extending therefrom in coplanar relationship with the side faces of the reclining head rest. These tabs are adapted for pivotally coupling with the side faces of the base adjacent to the end face to which the first gear is coupled. The reclining head rest further includes a dial rotatably coupled to one of the side faces thereof with a second gear coupled thereto. Such second gear resides within an interior space of the reclining head rest and remains in engagement with the first gear of the base. This allows the selective pivoting of the reclining head rest by way of the rotation of the dial. For receiving and supporting a neck of a child, a top one of the end faces has a semicircular cut out formed therein. See FIG. 3.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reclining shampoo support for children apparatus and method which has many of the advantages of the child shampoo supports mentioned heretofore and many novel features that result in a new reclining shampoo support for children which is not anticipated, rendered obvious, suggested, or even implied by any of the prior art child shampoo supports, either alone or in any combination thereof.

It is another object of the present invention to provide a new reclining shampoo support for children which may be easily and efficiently manufactured and marketed.

It is a further object of the present invention to provide a new reclining shampoo support for children which is of a durable and reliable construction.

An even further object of the present invention is to provide a new reclining shampoo support for children which is susceptible of a low cost of manufacture with regard to both materials and labor, and which accordingly is then susceptible of low prices of sale to the consuming public, thereby making such reclining shampoo support for children economically available to the buying public.

Still yet another object of the present invention is to provide a new reclining shampoo support for children which provides in the apparatuses and methods of the prior art some of the advantages thereof, while simultaneously overcoming some of the disadvantages normally associated therewith.

Still another object of the present invention is to provide a new reclining shampoo support for children for supporting a head of a child at various angles for shampooing purposes.

Even still another object of the present invention is to provide a new reclining shampoo support for children that includes a base and a reclining head rest pivotally coupled to the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new reclining shampoo support for children according to the present invention.

FIG. 2 is a top view of the present invention.

DESCRIPTION OF THE PREFERRED EMBODIMENT

Figure 3:
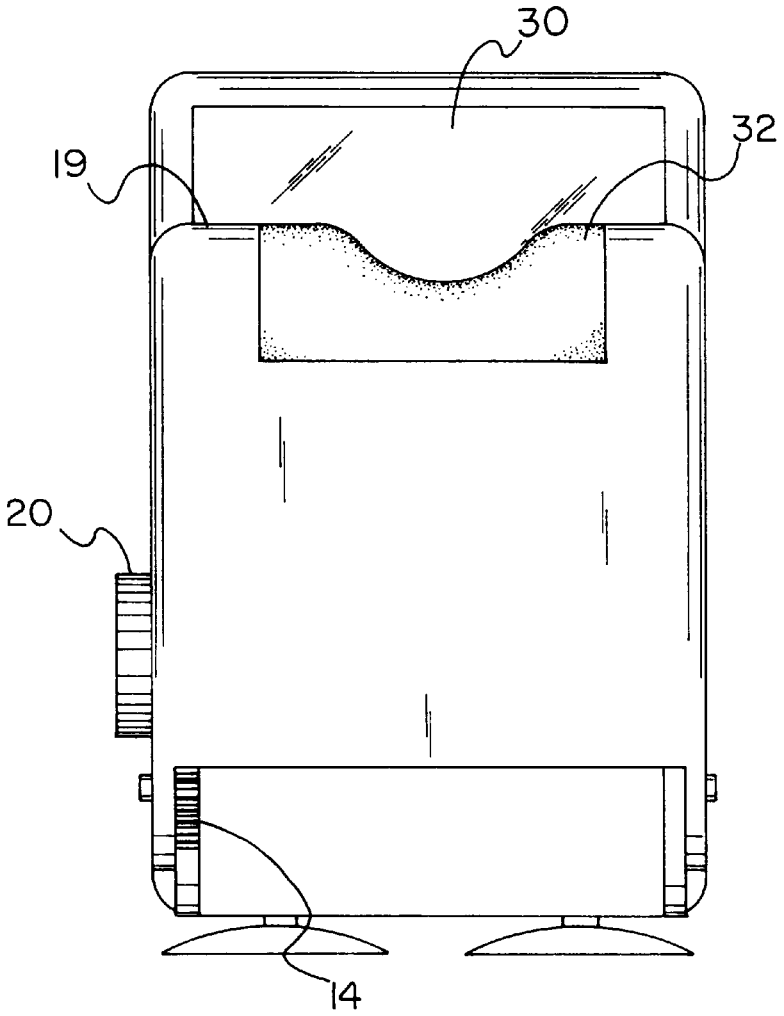
FIG. 3 is a rear view of the present invention.
Figure 4:
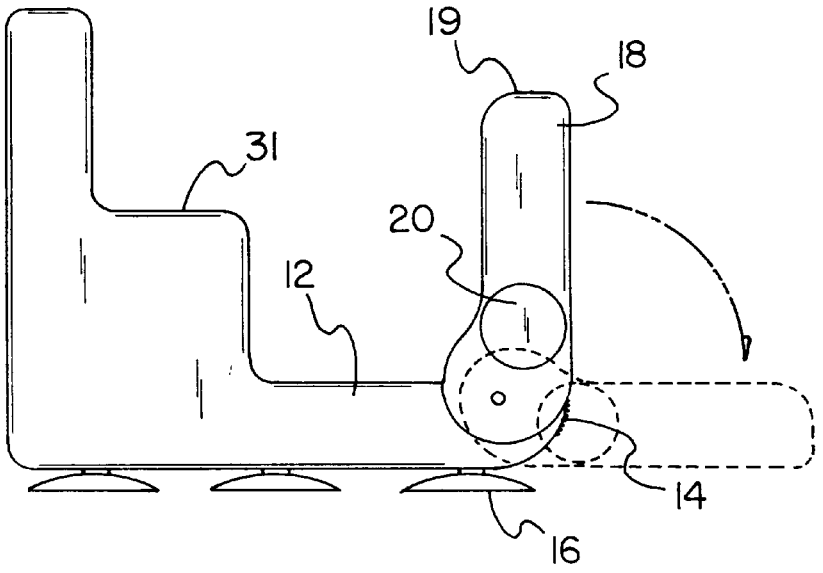
FIG. 4 is a side view of the present invention depicting the pivotal nature of the reclining head rest.

With reference now to the drawings, and in particular to FIGS. 1 through 5 thereof, a new reclining shampoo support for children embodying the principles and concepts of the present invention and generally designated by the reference numeral 10 will be described.

The present invention, designated as numeral 10, includes a base 12 having a rectangular configuration with a top face, a bottom face, and a periphery formed therebetween. Such periphery is defined by a pair of elongated side faces and a pair of short end faces. One of the end faces has a first gear 14 fixedly coupled thereto in coplanar relationship with one of the side faces for reasons that will become apparent hereinafter. The bottom face of the base has a plurality of suction cups 16 mounted thereon and depending therefrom for coupling with a tub, as shown in FIG. 1. Ideally, at least three suction cups are mounted between the end faces of the base.

Next provided is a reclining head rest 18 having a square configuration with a top face, a bottom face, and a periphery formed therebetween. Such periphery is defined by a pair of side faces and a pair of end faces. In the preferred embodiment, a length of the head rest is about ½ that of the base and a width of the head rest is equal to that of the base. A bottom one of the end faces has a pair of tabs integrally coupled thereto and extending therefrom in coplanar relationship with the side faces of the reclining head rest. These tabs are adapted for pivotally coupling with the side faces of the base adjacent to the end face to which the first gear is coupled.

The reclining head rest further includes a dial 20 rotatably coupled to one of the side faces thereof with a second gear 22 coupled thereto. Such second gear resides within an interior space of the reclining head rest and remains in engagement with the first gear of the base. This allows the selective pivoting of the reclining head rest by way of the rotation of the dial. As an option, a ratchet mechanism similar to that used in the art of pool chairs may be used to prevent the collapsing of the reclining head rest. For receiving and supporting a neck of a child, a top end face 19 of the pair of end faces of the head rest has a semicircular cut out formed therein. See FIG. 3.

Figure 5:
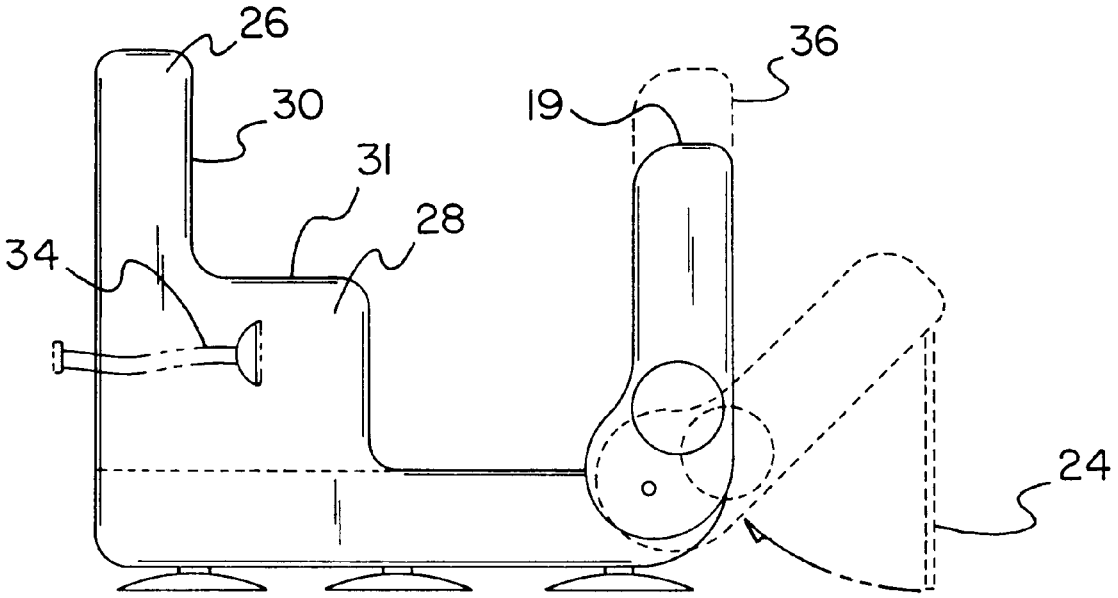
FIG. 5 is a side view of the present invention with an optional support plate included therewith.

As shown in FIG. 5, the reclining head rest has a planar support plate 24 having a top edge pivotally coupled along the top end face thereof. By this structure, the support plate is pivotable between a retracted orientation in coplanar relationship with the reclining head rest and a deployed orientation in a vertical orientation for resting on the tub for supporting the head rest. When the planar support is used, the reclining head rest resides at a 45 degree angle. It should be noted that the support is employed in conjunction with the ratchet mechanism as a back-up, or alternative, means of preventing the collapsing of the head rest.

Finally, a detachable attachment 26 is provided including a rectangular block. In the preferred embodiment, the block 28 has a height twice that of the base, a width equal to that of the base, and a length equal to ½ that of the base. A bottom face of the block is detachable to the top face of the base such that one end face of the block remains in coplanar relationship with one of the end faces of the base. A top face of the block has a mirror 30 coupled thereto and extending upwardly therefrom in coplanar relationship with one of the end faces of the base. In use, the block has a resting surface 31 on which various toiletries may be situated. So that an adequate resting surface is afforded, the mirror preferably has a length less than ⅓ that of the block. It should be noted that the detachable attachment may be removably coupled by way of any sort of means including a slot and guide protrusion combination.

Further options of the present invention include a flexible mat 32 mounted between the top face of the head rest and base for providing a continuous surface, as shown in FIG. 2. Further, a hand held shower head 34 may be provided which is fixable to the present invention and removably attached to a conventional shower spigot. Such shower head facilitates the bathing of the child. Note FIG. 5. Also shown in such Figure is a telescoping extension 36 formed on the reclining head rest for accommodating children of different sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support for a child comprising, in combination:

a base having a rectangular configuration with a top face, a bottom face, and a periphery formed there between and defined by a pair of elongated side faces and a pair of short end faces, one of the end faces having a first gear fixedly coupled to the end face, the bottom face of the base having a plurality of suction cups mounted thereon and depending therefrom for coupling with a tub;

a reclining head rest having a square configuration with a top face, a bottom face, and a periphery formed there between and defined by a pair of side faces and a pair of end faces, a bottom end face of the pair of end faces of the reclining head rest having a pair of tabs integrally coupled thereto and extending therefrom in coplanar relationship with the side faces of the reclining head rest for pivotally coupling with the side faces of the base adjacent to the end face to which the first gear is coupled, the reclining head rest further including a dial rotatably coupled to one of the side faces thereof with a second gear coupled thereto and residing within an interior space of the reclining head rest and in engagement with the first gear of the base for allowing the selective pivoting of the reclining head rest by way of the rotation of the dial, wherein a top end face of the pair of end faces of the reclining head rest has a semicircular cut out formed therein for receiving a neck of a child;

said reclining head rest having a planar support plate having a top edge coupled along the top end face of the reclining head rest thereby being pivotable between a retracted orientation in coplanar relationship with the reclining head rest and a deployed orientation in a vertical orientation for resting on the tub for supporting the head rest;

an attachment including a rectangular block having a height twice that of the base, a width equal to that of the base, and a length equal to ½ that of the base, a bottom face of the block being coupled to the top face of the base such that one end face of the block remains in coplanar relationship with one of the end faces of the base, a top face of the block having a mirror coupled thereto with one of the end faces of the base thereby providing a resting surface in front thereof on which various toiletries may be situated; and a flexible mat mounted between the top face of the head rest and base for providing a continuous surface thereon.

2. A support for a child comprising a base;

a reclining head rest pivotally coupled to the base; and wherein the base includes a mirror and resting surface for supporting various toiletries.

3. A support for a child as set forth in claim 2 wherein a top end face of the reclining head rest has a semicircular cut out formed therein for receiving a neck of a child.

* * * * *